US007357738B2

(12) United States Patent
White et al.

(10) Patent No.: US 7,357,738 B2
(45) Date of Patent: Apr. 15, 2008

(54) REINFORCED SPORTS SUPPORT POLE

(75) Inventors: Ronald White, North Praire, WI (US); Thomas Strunsee, Waukesha, WI (US); Anthony Grinwald, Rubicon, WI (US)

(73) Assignee: Russell Corporation, Atlanta, GA (US)

( * ) Notice: Subject to any disclaimer, the term of this patent is extended or adjusted under 35 U.S.C. 154(b) by 136 days.

(21) Appl. No.: 11/215,306

(22) Filed: Aug. 31, 2005

(65) Prior Publication Data

US 2007/0049429 A1 Mar. 1, 2007

(51) Int. Cl.
*A63B 63/08* (2006.01)

(52) U.S. Cl. ..... 473/481; 473/479

(58) Field of Classification Search ..... 473/479, 473/481; 403/305, 310; 52/682, 685, 301, 52/677, 719, 309.1, 684, 687
See application file for complete search history.

(56) References Cited

U.S. PATENT DOCUMENTS

| | | | | | |
|---|---|---|---|---|---|
| 87,015 | A | | 2/1869 | Varian | |
| 225,683 | A | | 3/1880 | Bragy | |
| 432,043 | A | | 7/1890 | Heiland | |
| 592,660 | A | | 10/1897 | Miller | |
| 611,568 | A | | 2/1898 | Dohme | |
| 753,709 | A | * | 3/1904 | Jones | 52/297 |
| 771,042 | A | | 9/1904 | Calkins | |
| 837,820 | A | | 12/1906 | Folsom | |
| 841,064 | A | * | 1/1907 | Stanley | 52/721.2 |
| 849,922 | A | * | 4/1907 | Scofield | 52/687 |
| 982,380 | A | | 1/1911 | Martin | |
| 1,008,210 | A | * | 11/1911 | Skinner | 52/260 |
| 1,095,197 | A | | 5/1914 | Entenmann | |
| 1,564,109 | A | | 12/1925 | Ponsolle | |
| 1,606,697 | A | | 11/1926 | Dean | |
| 1,611,935 | A | | 12/1926 | Mitchell | |
| 1,799,314 | A | | 4/1931 | Ptaff | |
| 2,194,779 | A | | 3/1940 | Albach | |
| 2,283,987 | A | | 5/1942 | Hammer | |
| D139,311 | S | | 10/1944 | Gibson | |
| 2,888,111 | A | | 5/1959 | Evans | |
| 2,932,511 | A | | 1/1960 | Bemis | |
| 2,945,659 | A | | 7/1960 | McDonald | |
| 2,985,261 | A | | 5/1961 | Kubesh | |
| 3,170,721 | A | | 2/1965 | Wells | |
| 3,292,335 | A | * | 12/1966 | Stober | 52/677 |
| 3,318,560 | A | | 5/1967 | Garrette, Jr. et al. | |
| 3,342,444 | A | | 9/1967 | Nelson | |
| 3,417,525 | A | | 12/1968 | Dashio | |
| 3,544,110 | A | * | 12/1970 | Dickinson | 473/483 |
| 3,586,324 | A | | 6/1971 | Bearson | |
| 3,671,738 | A | | 6/1972 | Beachley | |
| 3,765,676 | A | | 10/1973 | Bearson | |

(Continued)

*Primary Examiner*—Eugene Kim
*Assistant Examiner*—M. Chambers

(57) ABSTRACT

The present invention relates to a sports support pole, and more particularly to a reinforced support structure for supporting a pole such as a basketball pole or the like. The support structure may include a support bar positioned substantially in the center of the sports pole and may be held in position by one or more spacers. Cement may then be poured into the sports pole, with the spacers holding the support bar in position. Once the cement is cured, the support bar provides reinforcement to the sports pole against tension and shearing forces and the cement provides reinforcement against compression forces. An alternative embodiment provides for three or more support bars positioned at substantially equivalent intervals adjacent to the inner diameter of the sports pole.

9 Claims, 11 Drawing Sheets

U.S. PATENT DOCUMENTS

| | | | | | |
|---|---|---|---|---|---|
| 3,783,574 | A | * | 1/1974 | Cennerelli | 52/687 |
| 3,843,079 | A | | 10/1974 | Reisling | |
| 4,279,104 | A | | 7/1981 | Classen | |
| 4,307,887 | A | | 12/1981 | Weiss | |
| 4,395,040 | A | | 7/1983 | White | |
| 4,465,277 | A | | 8/1984 | Rolffs | |
| 4,522,394 | A | | 6/1985 | Broussard | |
| 4,634,422 | A | | 1/1987 | Cramblett | |
| 4,801,142 | A | | 1/1989 | Friesen | |
| 4,869,501 | A | | 9/1989 | Anastasakis | |
| 4,881,734 | A | | 11/1989 | Nye | |
| 4,940,232 | A | | 7/1990 | Chen | |
| 4,999,966 | A | | 3/1991 | Johnson et al. | |
| 5,037,093 | A | | 8/1991 | Roark | |
| 5,211,393 | A | | 5/1993 | Rolffs | |
| 5,316,315 | A | | 5/1994 | Roark | |
| 5,337,989 | A | | 8/1994 | Apple | |
| 5,347,787 | A | * | 9/1994 | Gavin | 52/677 |
| 5,398,478 | A | | 3/1995 | Gordin et al. | |
| 5,417,511 | A | | 5/1995 | Warden | |
| 5,492,429 | A | | 2/1996 | Hodges | |
| 5,571,229 | A | | 11/1996 | Fitzsimmons | |
| 5,704,188 | A | | 1/1998 | Coulis | |
| 5,752,349 | A | | 5/1998 | Fitzsimmons et al. | |
| 5,758,857 | A | | 6/1998 | Gray | |
| 5,822,946 | A | * | 10/1998 | Rasmussen | 52/687 |
| 6,385,938 | B1 | * | 5/2002 | Gavin | 52/677 |
| 6,571,526 | B2 | * | 6/2003 | Queen | 52/677 |
| 2002/0007613 | A1 | | 1/2002 | Gordin et al. | |

* cited by examiner

REINFORCED SPORTS SUPPORT POLE

FIELD OF THE INVENTION

This invention relates to a sports support pole, and more particularly to a reinforced support structure for supporting a sports pole such as a basketball pole or the like.

BACKGROUND OF THE INVENTION

When traveling through most neighborhoods, one can typically find a freestanding basketball hoop/backboard assembly erected in a neighborhood playground or adjacent to a residential driveway.

It is desirable to secure a support pole for such a freestanding backboard assembly as rigidly as possible in the ground to minimize or dampen out vibrations that are generated by a basketball striking the backboard assembly and/or the support pole. Toward this objective, the lower end of a freestanding support pole may be placed into the ground adjacent a playing surface while an upper end of the support pole supports the backboard assembly secured thereto. To further secure a support pole to the playing surface and provide additional safety, cement is often placed inside of the pole.

In some instances, the lower end of the support pole is encased in cement, asphalt, or the like to more securely maintain the support pole in a fixed and erect position. In other instances, the lower end of the support pole may be inserted into a ground sleeve securely fixed in the ground. The ground sleeve allows the pole to be as stable as a permanent in-ground pole, while still being removable as desired, such as for special occasions.

One incident of providing a rigidly fixed free standing support pole by any method is that the support pole is often left in the ground for long periods of time. During long periods of inclement weather, the support pole, typically made from cast iron, steel, or aluminum tubing (hereafter referred to as "metal"), is susceptible to rusting and/or corrosion that deteriorates the appearance and eventually the structural integrity of the metal. In some cases, the exposure to the weather or chemicals, such as pesticides and others, may result in holes or even rings of metal around the base of the support pole that have been eaten away by rusting and/or corrosion.

Additionally, support poles are often damaged by contact with lawn equipment, by vehicle collisions, and/or by stresses induced during play. In any case, if the metal of the support pole is damaged or its structural integrity is compromised by rust and/or corrosion, the pole may fall due to forces exerted on the damaged area during play.

Although a pole filled with cement provides additional weight and stability during play, the cement does not significantly reinforce the strength of the support pole if the base of the support pole has been compromised by rust and/or corrosion as discussed above. As one of ordinary skill in the art would understand, the concrete in the pole acts poorly in tension to reinforce the pole or resist the bending of the concrete within the pole at the location of the failure. In other words, if the metal pole fails at its base, the concrete inside simply snaps.

Although a pole with a much thicker wall thickness, or a solid metal pole may appear to provide the additional needed structural integrity, such a pole proves prohibitive due to costs and additional weight. Not only is the cost of manufacturing a thicker pole more expensive, but also the additional weight significantly increases production, handling, and shipping costs. Further, the effort required to assemble a thicker pole is beyond the abilities of the average consumer.

Furthermore, simply including additional wall thickness of all support poles fails to provide the consumer with the option, significantly increasing the cost of the product with little if any increased value to the consumer. While some environments are especially corrosive, where additional structural support is desired, other environments do not require additional structural support in order to prolong the life of the support pole. For example, the outdoor backyard basketball court may benefit from additional structural support due to its exposure to inclement weather and time. However, the inclusion of heavy, difficult-to-assemble support poles for an indoor basketball court is overkill.

Therefore, there is a need for a reinforced sports pole that is selectable for the environmental conditions and provides additional support during a failure of the sports pole.

SUMMARY OF THE INVENTION

This invention relates to a sports support pole, and more particularly to a reinforced support structure for supporting a pole such as a basketball pole or the like.

One embodiment of the present invention may include a reinforced sports support structure comprising a substantially hollow sports pole for supporting a sports apparatus above a playing surface with the hollow sports pole forming a cavity and having a central axis. The support structure may include at least one support bar having a first end and a second end with the at least one support bar further including a first portion and a second portion. The support structure may also include at least one spacer configured to be inserted along with the at least one support bar into the cavity of the support pole to substantially secure the at least one support bar in a predetermined position. Wherein, the at least one spacer maintains the predetermined position of the at least one support bar as the cavity of the sports pole is at least partially filled with a fill material such that the at least one support bar is substantially encased in the fill material and wherein the first portion, including the first end, is positioned below the playing surface and a second portion, including the second end, is positioned above the playing surface.

Another embodiment of the present invention may include a method for reinforcing a hollow sports pole forming a cavity with the method comprising the steps of attaching at least one spacer to at least one support bar, the at least one support bar including a first end and a second end and a first portion and a second portion. The steps may include inserting the at least one support bar and the at least one spacer into the cavity of the sports pole with the at least one spacer being configured to maintain the at least one support bar in a predetermined position within the sports pole. The steps may also include maintaining the at least one support bar in the predetermined position while filling at least a portion of the cavity of the sports pole with a fill material such that the at least one support bar is substantially encased in the fill material and placing the sports pole such that the first portion, including the first end, is positioned below a playing surface and a second portion, including the second end, is positioned above the playing surface.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the Figures in which various embodiments of the present invention are shown. The subject matter of this disclosure may, however, be embodied in many different forms and should not be construed as being limited to the embodiments set forth herein.

Figure 1:
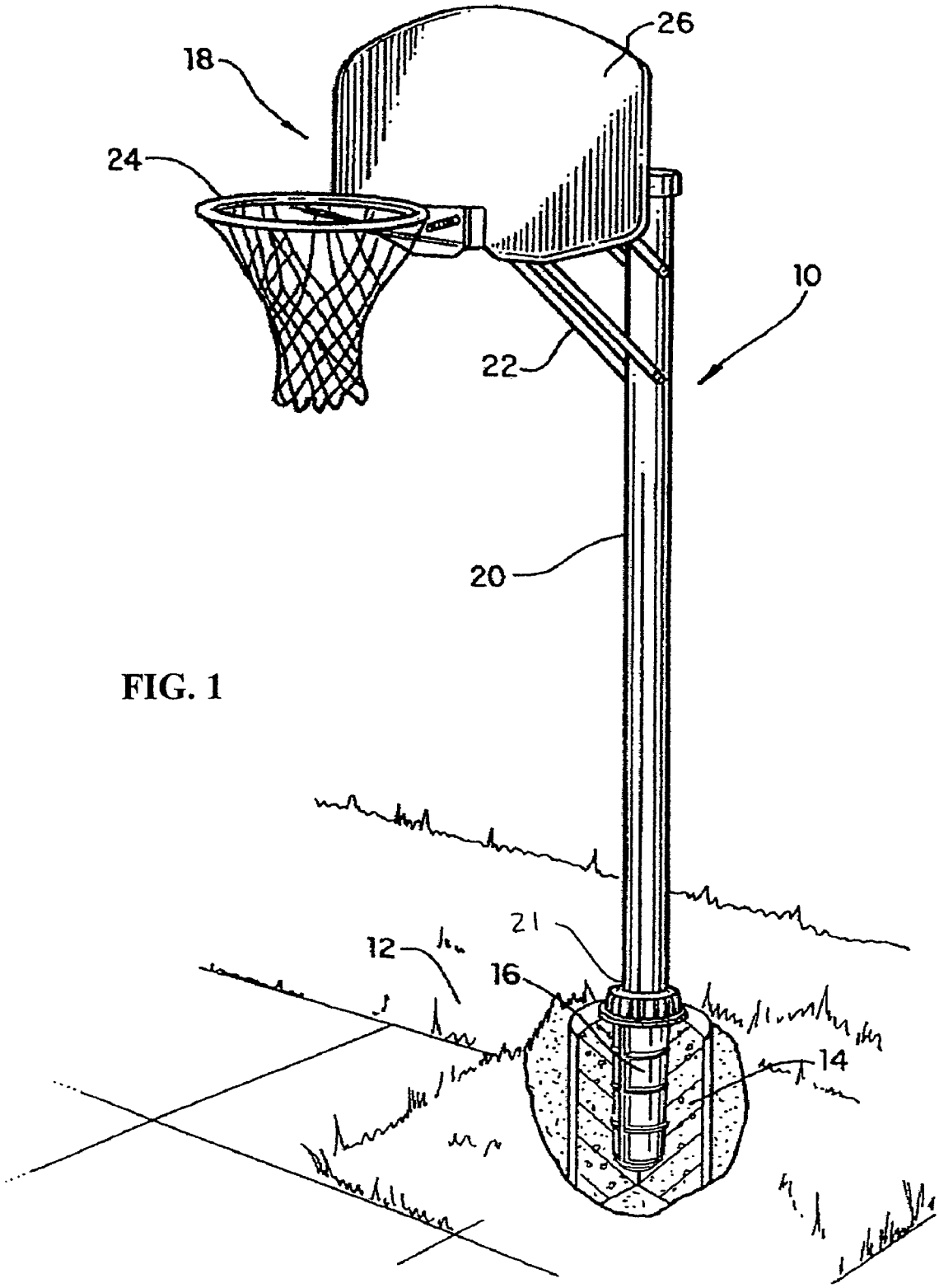
FIG. 1 is a perspective cut-away view of a support pole fixed in the ground for supporting a basketball backboard assembly.

FIG. 1 is a perspective cut-away view of a sports support pole fixed in the ground for supporting a basketball backboard assembly. A basketball goal 10 may include a backboard assembly 18 which may be mounted to an upper portion of the support pole 20 by a plurality of support struts 22 in a conventional manner. The backboard assembly 18 may include a basketball rim/net assembly 24 secured to and extending outwardly from a backboard 26. In one embodiment of the present invention, the reinforced support pole 20 may be removably anchored in the ground 12 in a rigidly fixed and upright position by a ground sleeve 16 fixed in a cement casing 14. Alternatively, the support pole 20 may be fixed directly in the cement casing 14 without the use of a ground sleeve 16. Regardless, the extended exposure of the support pole 20 to weather and the elements often causes rusting and exposure along the base 21 of the support pole 20.

Figure 2A:
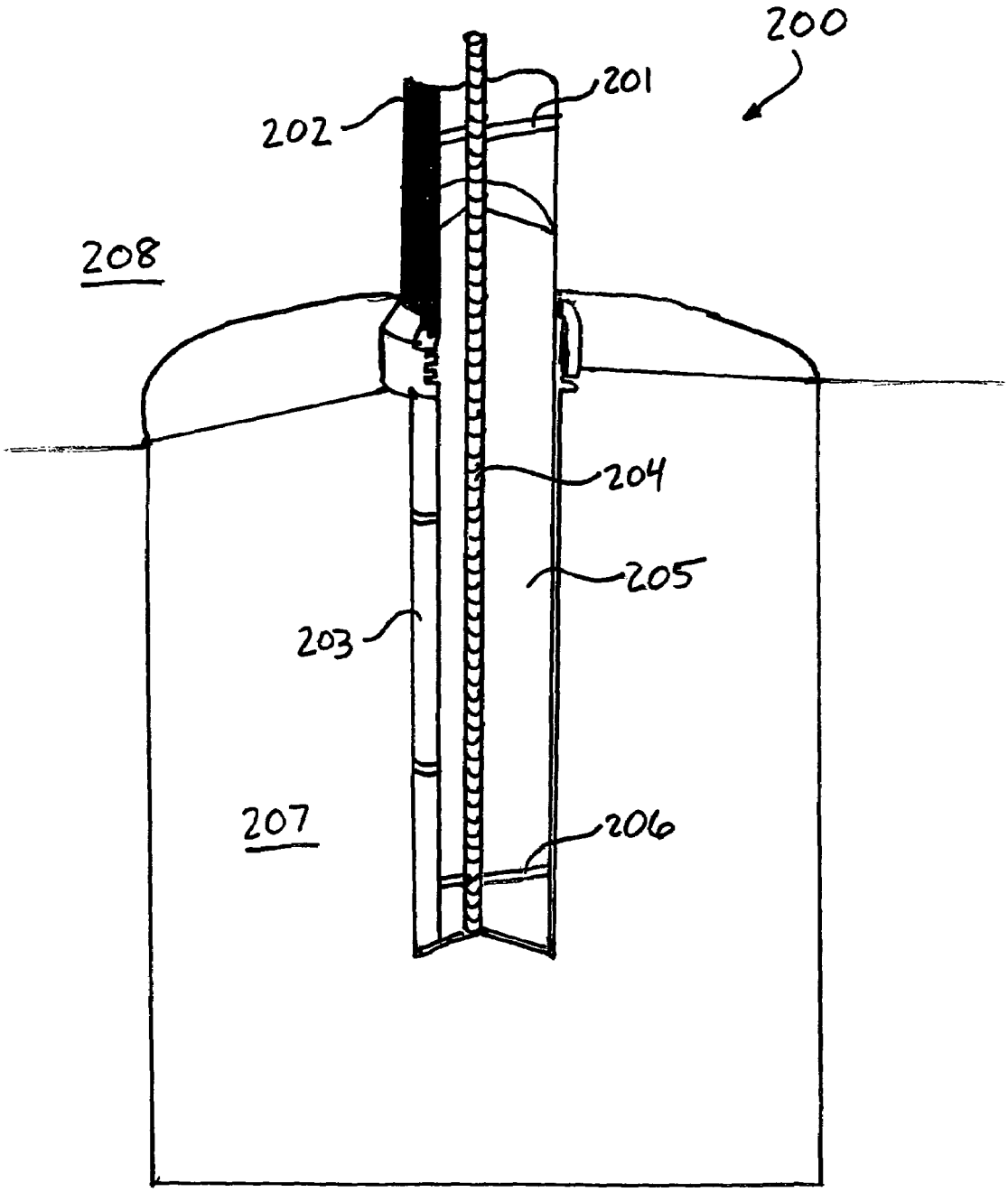
FIG. 2A is a perspective cut-away view of a system for reinforcing a support pole fixed in the ground according to one embodiment of the invention.

FIG. 2A is a perspective cut-away view of a system for reinforcing a support pole fixed in the ground according to one embodiment of the invention. This embodiment of the system 200 may include a ground sleeve 203, a support pole 202, a reinforcing bar (often referred to as rebar) or a support bar 204, two spacers 201, 206 and cement casing 205, 207. In other embodiments, the ground sleeve 203 may or may not be used to anchor the support pole 202. Additionally, the entire structure may or may not be removably fixed in a cement casing 207. In any case, the support pole 202 may be rigidly mounted in either the ground 208 or a man-made playing surface (not shown).

The system shown in FIG. 2A is constructed in the following manner. Prior to being placed either in the ground 208 or in a man-made playing surface, the support bar 204, the spacers 201, 206 and the cement 205 may be placed inside of the support pole 202. To accomplish this, the spacers 201, 206 may be attached to the support bar 204 and the support bar 204 and spacers 201, 206 may be inserted into a bottom end of the support pole 202. The bottom of the support pole 202 containing the support bar 204 may then be sealed (not shown) with duct or other suitable tape, a cap, or various other means as readily apparent to one of skill in the art. Fill material, such as cement, concrete, asphalt, or other suitable material apparent to one of skill in the art, may then be poured into the unsealed top of the support pole 202 until the support pole it completely filled. It should be noted that the pole may or may not include multiple sections assembled into a single pole and that the pole may be filled to varying heights with fill material without deviating from the scope and spirit of the present invention.

Once the cement 205 is cured, the entire system may be placed in the ground 208. For the purpose of this specification, the ground may refer to the earth literally or any material or construction suitable for forming a playing surface and/or supporting the support pole. For example, the ground 208 may refer to a concrete or asphalt outdoor basketball court, where the basketball court may or may not extend down to the earth below. However, the ground 208 may also refer to a wooden floor basketball court or other construction with structural support beneath. Once the support pole 202 is securely retained in the ground 208, the backboard assembly 18, as discussed with reference to FIG. 1, can be mounted to an upper end of the support pole 202 in a conventional manner.

Referring to the embodiment shown in FIG. 2A, the support bar 204 may be positioned inside of the support pole 202 by two spacers 201, 206. The spacers 201, 206 may maintain the position of the support bar 204 while cement is being poured into the support pole 202, as discussed above. Thus, once the poured cement 205 is cured, the support bar 204 may be permanently located substantially in the axial center of the support pole 202.

Figure 2B:
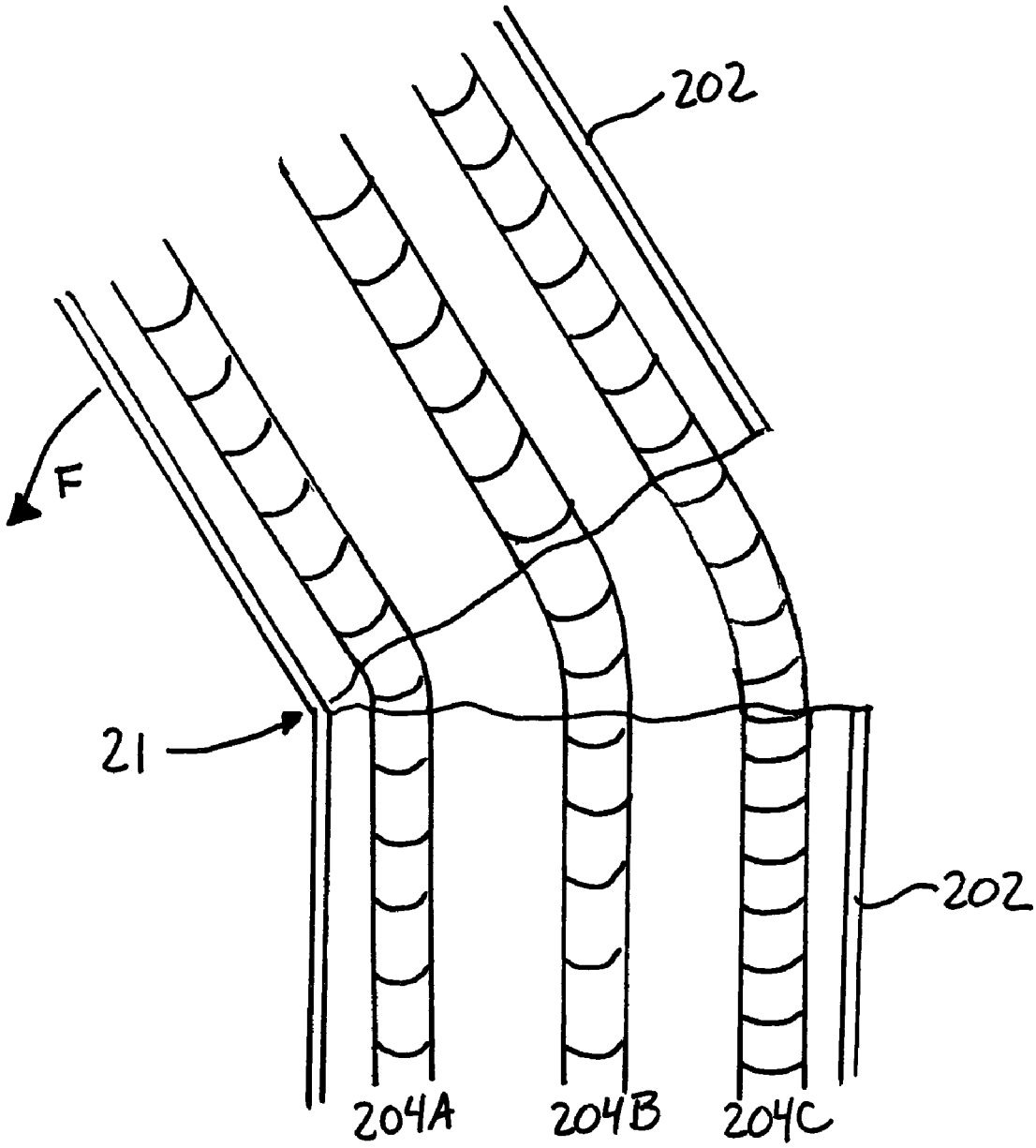
FIG. 2B is a cross sectional view of the base of the support pole during failure of the pole.

FIG. 2B shows a cross sectional view of the base of the support pole 202 during a failure of the pole 202 at the location 21 as shown in FIG. 1. As shown in FIG. 2B, the upper part of the pole 202 is substantially pivoting about the location 21 such that the upper part of pole 202 is falling to the left as indicated by Arrow F. Also shown in FIG. 2B are three possible positions 204A, 204B, and 204C of the support bar 204 within support pole 202.

A support bar in position 204A experiences significantly less tension, during a failure of the support pole 202 in the direction of Arrow F, than a support bar at position 204B or 204C. As a consequence, the support bar in position 204A, due to its proximity to location 21, fails to significantly resist the failure of the pole 202 in the direction of Arrow F, shown in FIG. 2B. Conversely, the support bar in position 204C would be best positioned to resist the fall of the upper part of the pole 202 because the support bar in position 204C is furthest from the point of rotation at location 21.

However, if the failure depicted in FIG. 2B occurred in the opposite direction of Arrow F, such that the pole 202 fell to the right about a point on the opposite side from location 21, then the support bar in position 204A would be best positioned to resist a fall to the right. Therefore, the support bar in position 204B, which is located substantially on the axial center of support pole 202, is the only support bar shown in FIG. 2B positioned to substantially resist failure of the pole 202 in any direction.

Although the support bar positions 204A, 204B, and 204C does suggest that simply lining the inner circumference with support bars would optimize the reinforcement of the support pole in any direction, this configuration is impractical due to cost and weight increases. The additional required support bars increases the costs of production for the numerous support bars, the costs of shipping the additional weight and size of the numerous support bars, and the difficulty of assembling, proving this configuration impractical and cost prohibitive.

However, it should be understood that simply placing a support bar 204 within the support pole 202 and filling the pole with cement is insufficient to practice the present invention because the support bar 204 will not remain substantially positioned on the axial center of the pole 202. As discussed, for a single support bar, the optimized position of the support bar 204 is on the axial center of the pole 202. From the axial center, the support bar 204 may provide additional structural support and reduce the rate of descent of the pole upon failure in any direction. However, attempting to balance or to hold the support bar 204 manually on the axial center while the pole is filled with cement is difficult if not impossible. Likewise, attempting to adjust the support pole 204 manually after the pole has been filled is equally difficult and also difficult to verify.

Figure 3A:
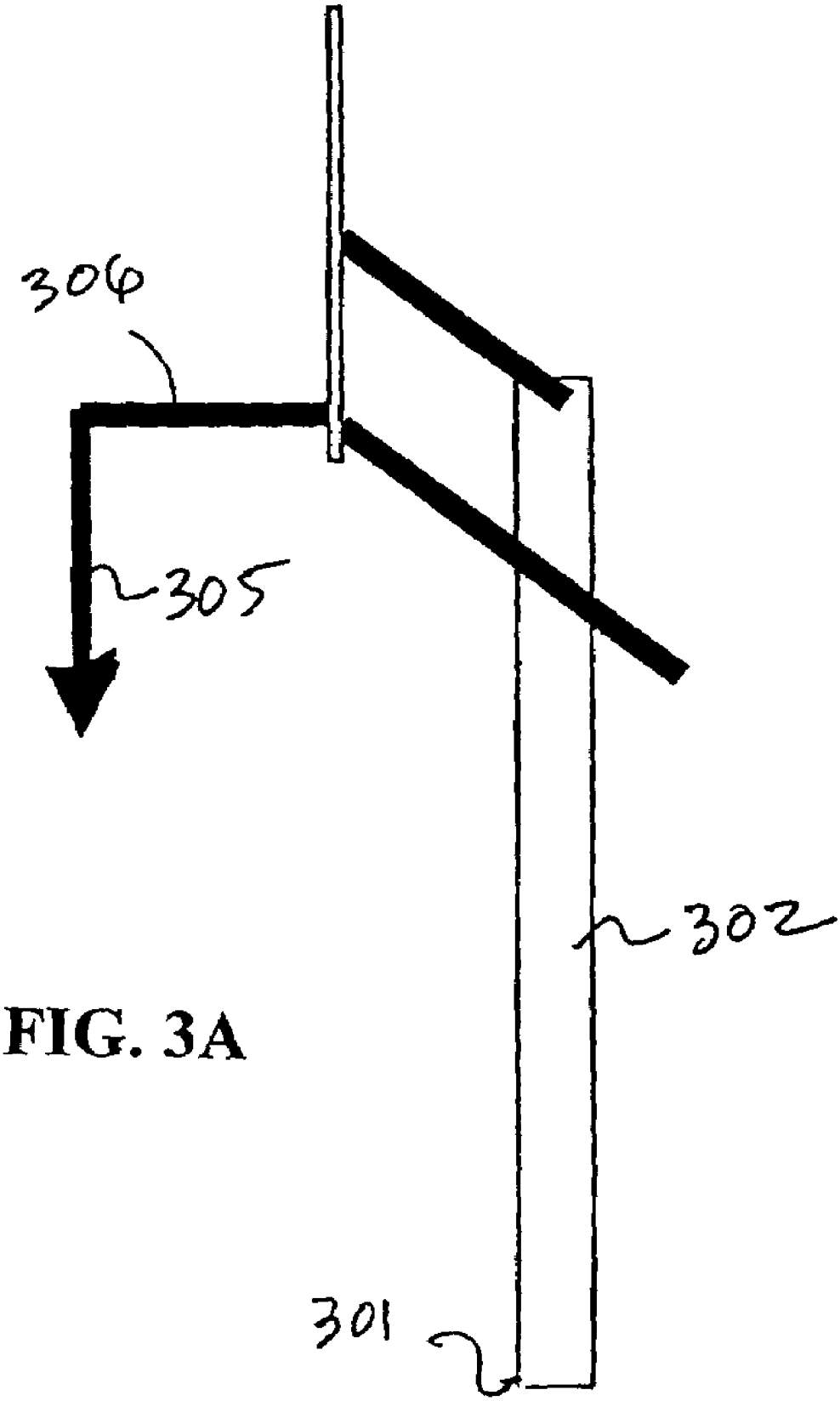
FIG. 3A is a view of an experimental setup for testing the strength of a support pole.

FIG. 3A illustrates a traditional configuration for a support pole and basketball goal apparatus. The configuration includes a support pole 302 and basketball goal or rim 306. The base 301 of the support pole 302 may be secured in the ground as discussed above. The arrow 305 indicates a load on the rim 306 which may be experience during play, especially when a player dunks a basketball or hangs from the rim 306. As mentioned above, the traditional configuration includes filling the support pole 302 with cement (not shown). It should be noted that the configuration shown in FIG. 3A does not include a support bar embedded within the base of the support pole 302.

In testing the traditional configuration, the support pole 302, filled with cement, was circumferentially cut at the base 301 to simulate weathered and rusted conditions of a structurally compromised support pole. The support pole 302 was cut such that only three small pieces of material, measuring only a 0.25-inch wide and equally spaced around the pole, were left supporting the basketball goal along with the cement (not shown). Under the configuration shown in FIG. 3A, the support pole 302 failed under the weight of the standard backboard and goal without zero additional load placed on the rim (arrow 305). Upon release of the basketball support pole 302, the support pole and cement immediately failed, taking only 2.19 seconds for the goal to completely fall and contact the ground.

Figure 3C:
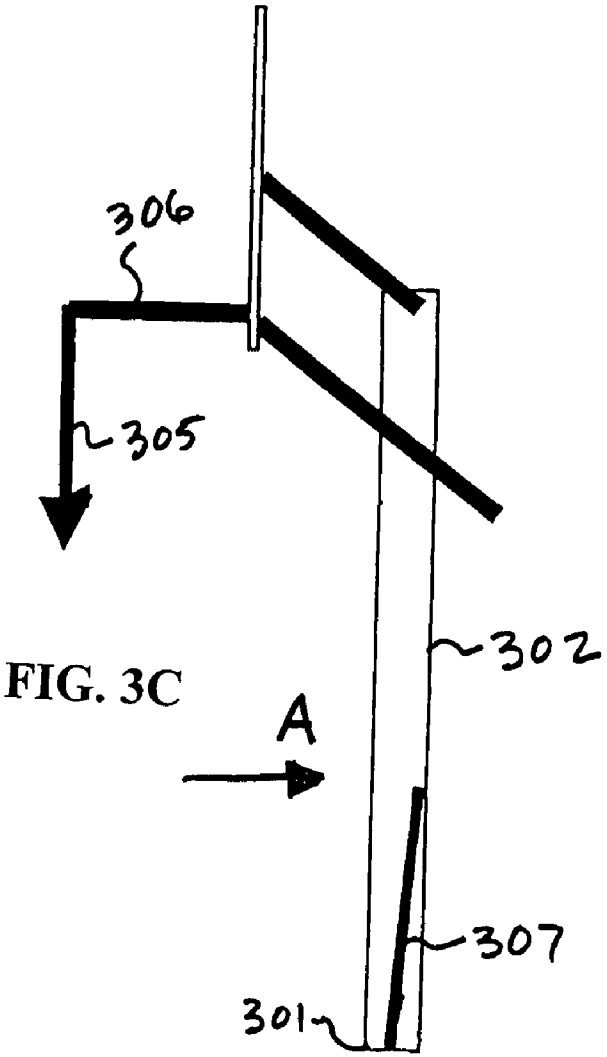
FIGS. 3B, 3C and 3D are views of various experimental setups used for testing the strength of a support pole with a support bar located in various positions within the support pole.
Figure 3B:
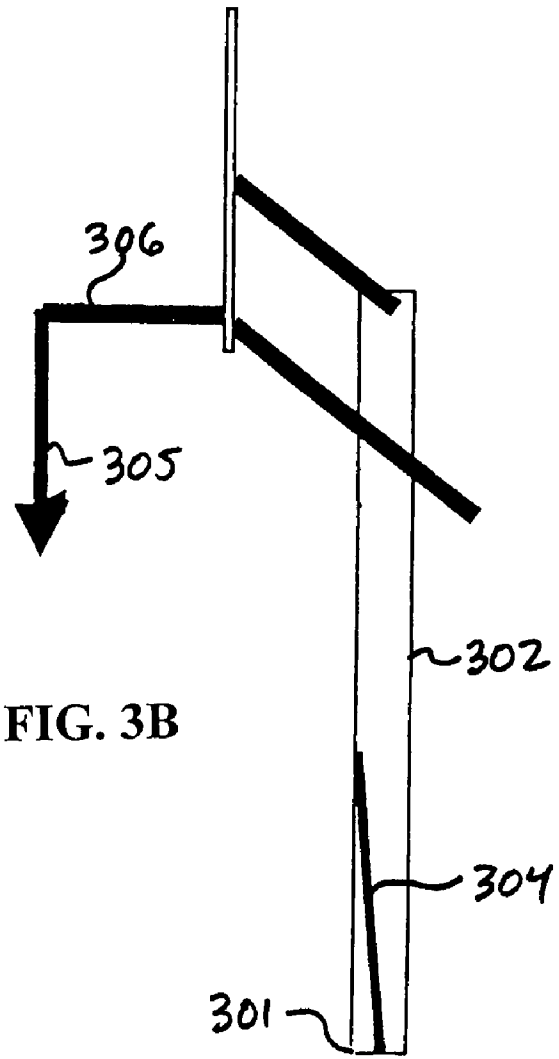
Figure 3D:
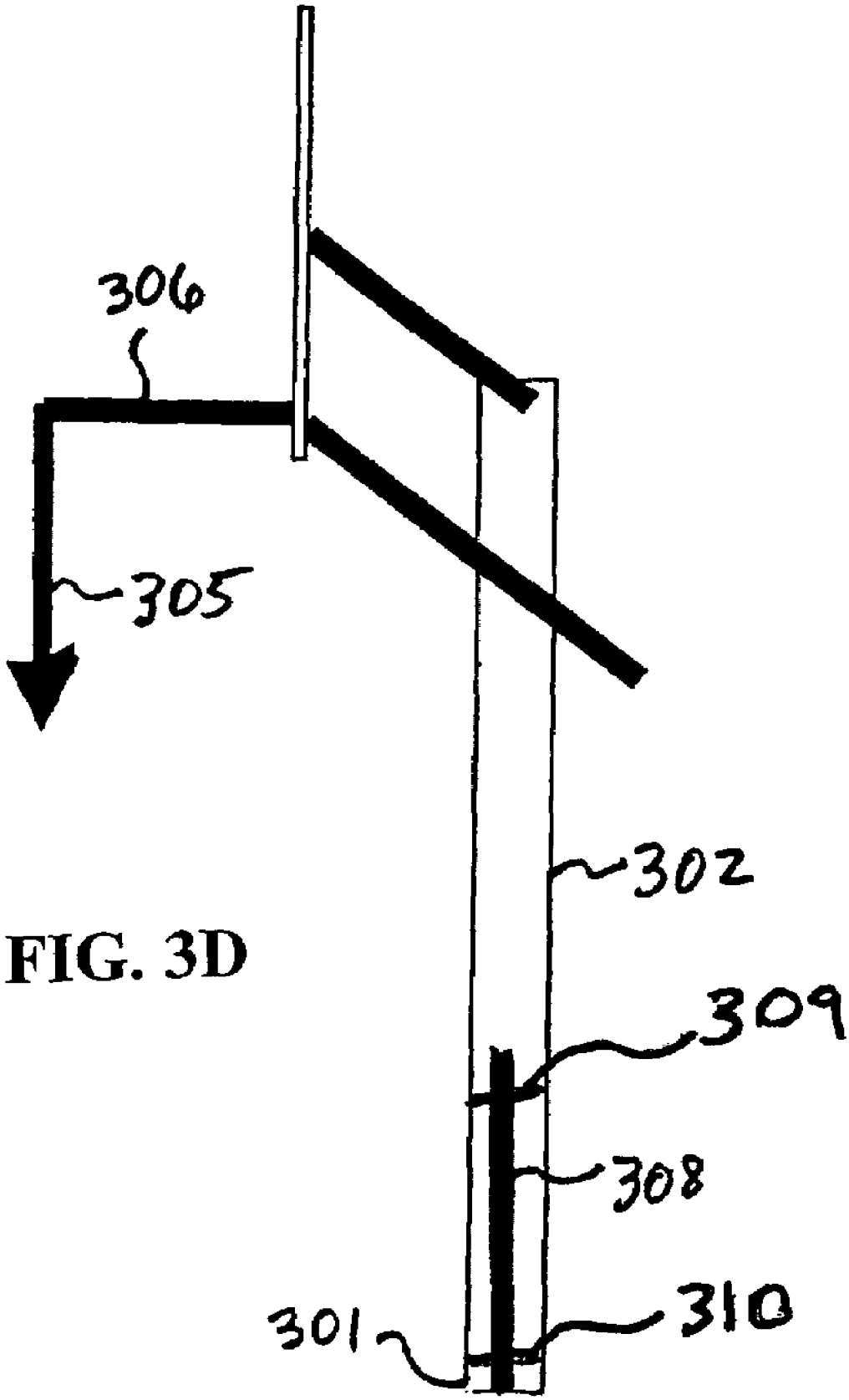

FIGS. 3B, 3C and 3D include reinforced configuration in accordance with the present invention including a support bar positioned in within the support pole 302 in various positions. In FIG. 3B, a support bar 304 is positioned with the bottom of the support bar 304 centered in the pole 302 and the top of the support bar 304 leaning against the front of the pole 302, the part of the pole 302 closest to the rim 306 and the applied load 305. The position of the support bar 304 represents the use of a support bar without the spacers 201 and 206 as shown in FIG. 2A. Without the spacers, the support bar 304 may be free to fall or be pushed by cement against the inner wall of the support pole 302. Under the configuration shown in FIG. 3B, the support pole 302 including the support bar 304, measuring 36" in length and 0.44" in diameter, failed after 75 lbs of load was placed on the rim indicated by arrow 305. The basketball goal took 3.16 seconds to completely fall.

In FIG. 3C, a support bar 307 is positioned with the bottom of the support bar 307 centered in the pole 302 and the top of the support bar 304 leaning against the back of the pole 302, the part of the pole 302 furthest from the rim 306 and the applied load 305. Again, FIG. 3C represents the use of the support bar 307 without the use of spacers to center the position of the support bar within the support pole. Under the configuration shown in FIG. 3C, the support pole 302 including a support bar 304, measuring 36" in length and 0.44" in diameter, failed after 257.6 lbs of load was placed on the rim indicated by arrow 305. Although the support pole 302 failed and the cement filling the pole cracked, the basketball goal did not completely fall forward but was held upright by the support bar 304.

In FIG. 3D, a support bar 308 is positioned with the top and bottom of the support bar 308 centered in the support pole 302. The spacers 309 and 310 positioned the support bar as shown in FIG. 3D maintain the position of the support bar 308 despite the support pole 302 being filled with cement. Under the configuration shown in FIG. 3D, the support pole 302 including the support bar 308, measuring 36" in length and 0.44" in diameter, failed under a 189 lbs load placed according arrow 305. The basketball goal took 5.62 seconds to completely fall.

The test results indicate that locating a support bar substantially in the axial center of a support pole provides both additional reinforcement against failure and increases the time the support pole takes to fall during failure, effectively reducing or eliminating the rate of descent of the basketball goal. Although the configuration shown in FIG. 3C (support bar 307 leaning against the back of the support pole 302) provided greater strength, even preventing the basketball goal from falling directly forward under the applied load, it should be understood that the support bar 307 would not have prevented the basketball goal from falling if the basketball goal had been pushed to either side or in the opposite direction. For example, the basketball goal shown in FIG. 3C may easily fall backwards after being struck in the direction of arrow A by a parking car or the like. Therefore, as discussed above, a single support bar 308 positioned substantially along the axial center of the support pole 302 (see FIG. 3D) optimizes the beneficial characteristics of including a single support bar, regardless of the direction of failure of the pole 302.

Referring back to FIG. 2A, one embodiment for implementing the present invention includes the spacers 201, 206, which may be attached substantially near the ends of the support bar 204 so as to prevent the support bar 204 from moving in any direction once it is placed inside the support pole 202. In one embodiment, the spacer 201 may be placed approximately two inches from the top of the support bar 204 and the spacer 206 may be placed approximately three inches from the bottom of the support bar 204. However, the spacers 201, 206 may be placed at any point on the support bar 204. Additionally, more than two spacers may be used along the length of the support bar 204 so as to provide additional stability in keeping the support bar 204 substantially in the center of the support pole 202 when cement is poured into the support pole 202.

The spacers 201, 206 may be formed as a single molded element or may be multiple elements attached together. Further, the spacers 201, 206 may be constructed of plastic, polypropylene, nylon, metal, wood, or various other materials known to one of skill in the art. It should be understood, however, that the spacers 201, 206 need only to be strong enough to maintain the position of the support bar 204 during the pouring of the cement and until the cement is cured.

Figure 4A:
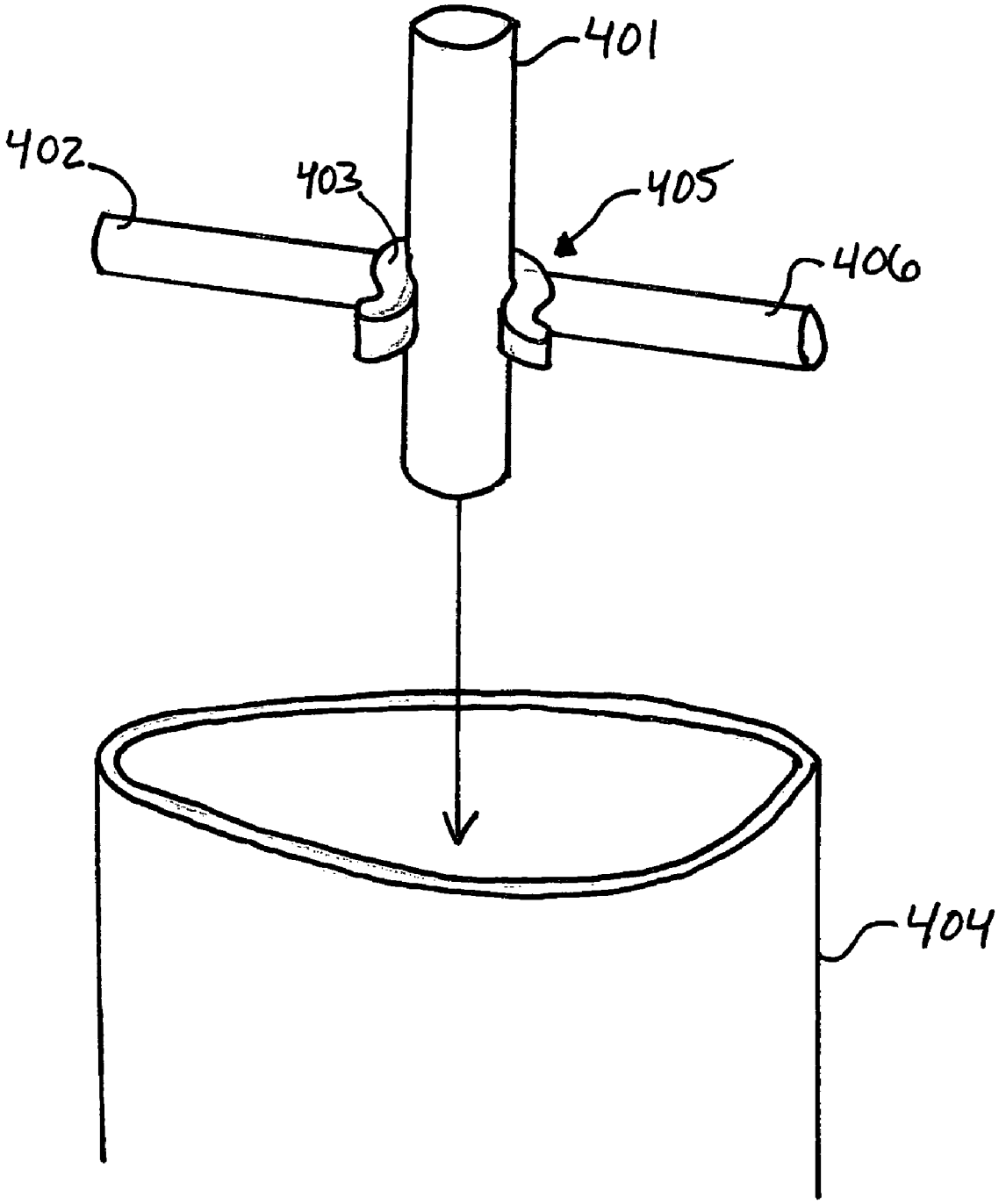
FIGS. 4A, 4B and 4C are views of a support bar and spacer according to alternative embodiments of the invention.
Figure 4B:
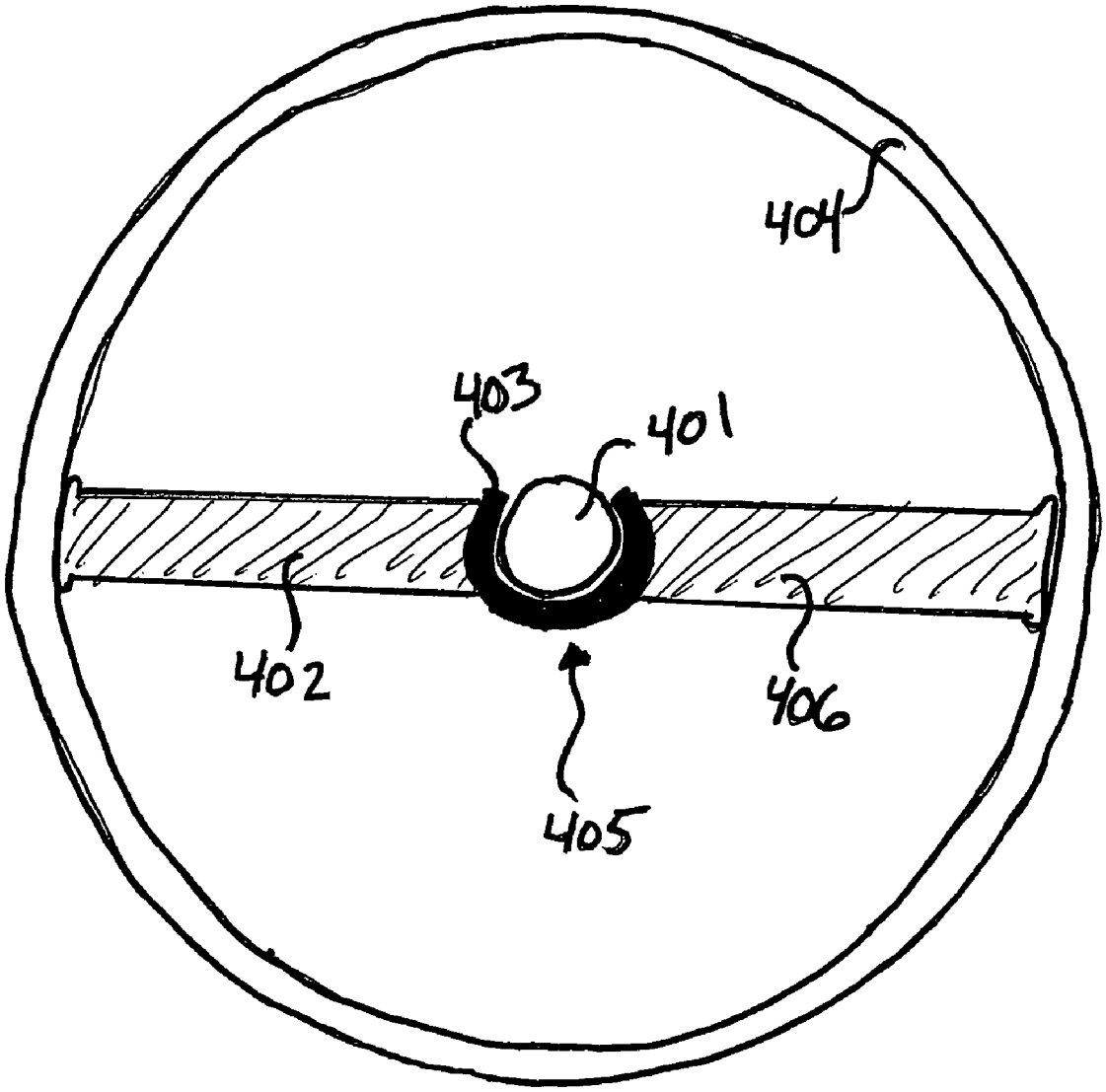
Figure 4C:
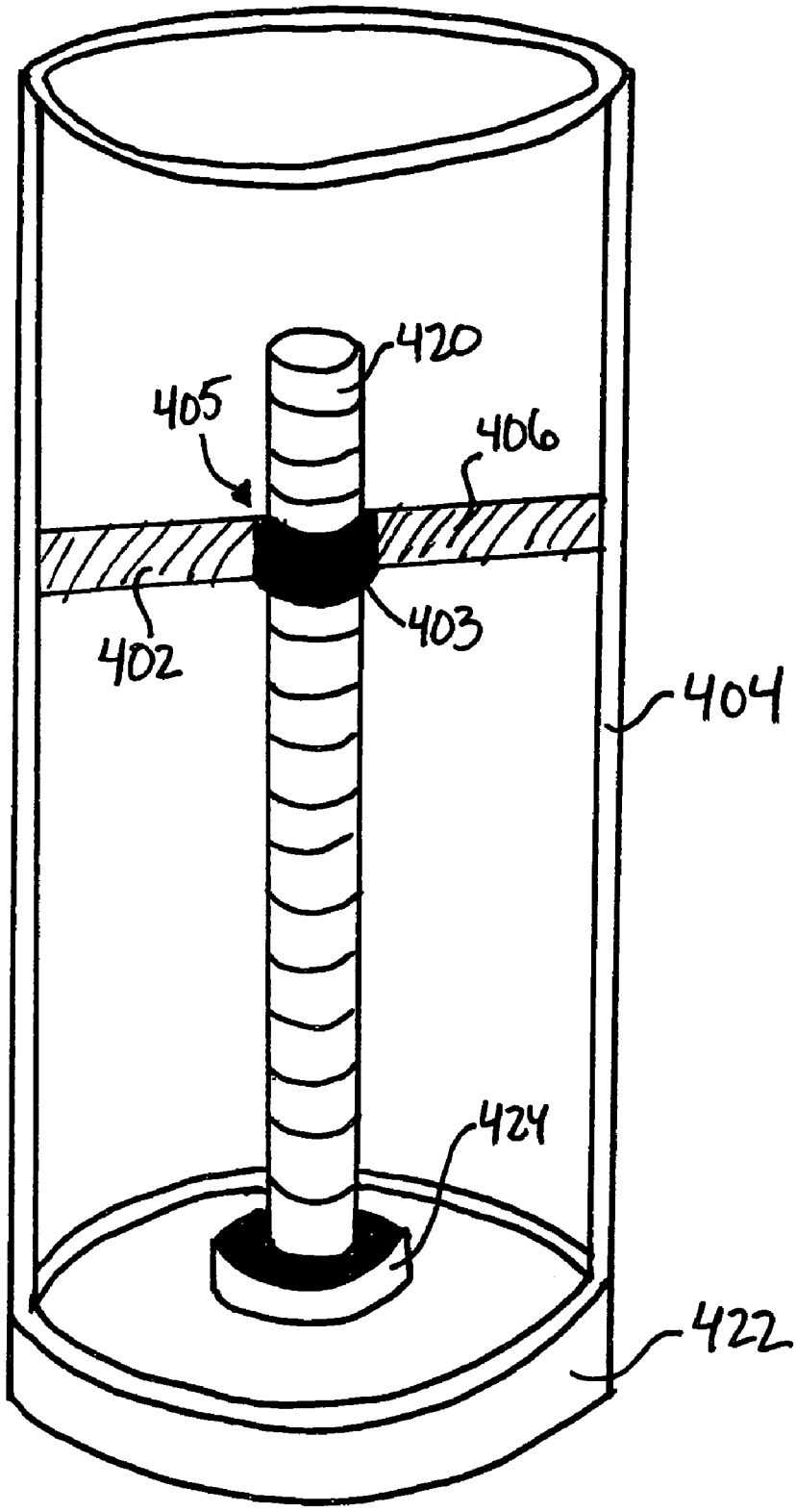

FIGS. 4A, 4B and 4C are views of support bars and spacers according to some embodiments of the invention. In the FIGS. 4A, 4B, and 4C, identical elements are labeled with the same reference number. As illustrated in FIGS. 4A and 4B, a support bar 401 and a spacer 405 are removably attached and inserted into a support pole 404. While only a single spacer is shown in FIGS. 4A and 4B, any number of spacers may be used in a similar manner, as discussed above with reference to FIG. 2. Alternatively, a cap 422 including a recessed portion 424 may be used instead of a spacer 405 to position the lower end of the support bar 420 as shown in FIG. 4C and to seal the lower end of the support pole as it is filled with cement.

As shown in FIGS. 4A, 4B, and 4C, the support bar 401 may include a metal bar with a ribbed exterior surface. However, it should be obvious to one of ordinary skill in the art that a number of different materials, such as hollow or solid metal tubing, fiberglass rod, plastic rod, composite rod, or the like, may be used to fabricate the support bar. Likewise, the exterior surface of the support bar may include any number of smooth or textured surfaces without deviating from the scope and spirit of the present invention.

Referring to FIG. 4A, the spacer 405 may include a clip or clasp 403 and two arm members 402, 406. The clip 403 may be configured to removably attach the spacer 405 to the support bar. The arm members 402, 406 may be configured such that, when the clip 403 is attached to the support bar, the arm members 402 and 406 protrude substantially perpendicular to the support bar. As such, when inserting the support bar and attached spacers 405, the arm members 402 and 406 geometrically position the support bar substantially on the central axis of the support pole as shown in FIG. 4B.

Although, in the embodiments shown in FIGS. 4A, 4B and 4C, the length of the arm members 402, 406 are shown to be equal and oppositely placed about the clip 403, the spacer 405 may include different sized arm members and different numbers of arm members as would be obvious to one of ordinary skill in the art.

As shown by the testing, the optimal position for a support bar is directly opposite from the direction of the failure or fall, shown as position 204C in FIG. 2B. Following from this, alternative embodiments of the present invention may include multiple support bars spaced around the inner circumference of the support pole. The multiple support bars may be used in addition to or as a replacement for the single support bar located substantially in the axial center of the support pole as shown in FIG. 2A. In these embodiments, the multiple support bars may be held in positions around the inner circumference of the support pole by a spacer, with each support bar being held substantially adjacent to the inner wall of the support pole. In order to optimize the reinforcement of the support pole in any direction, the multiple support bars may be placed at substantially equal intervals around the inner circumference.

Figure 6A:
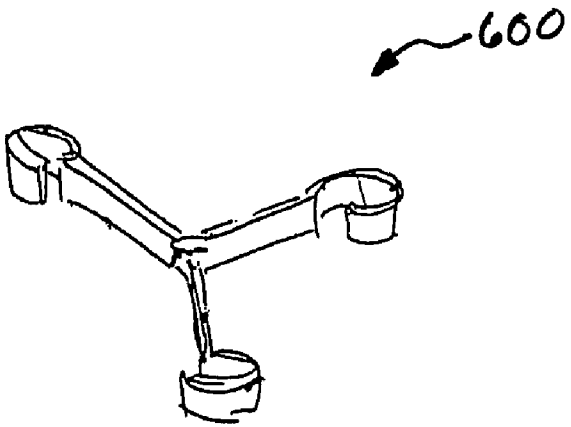
FIGS. 6A and 6B are views of a spacer for use with three support bars according to one embodiment of the invention.
Figure 6B:
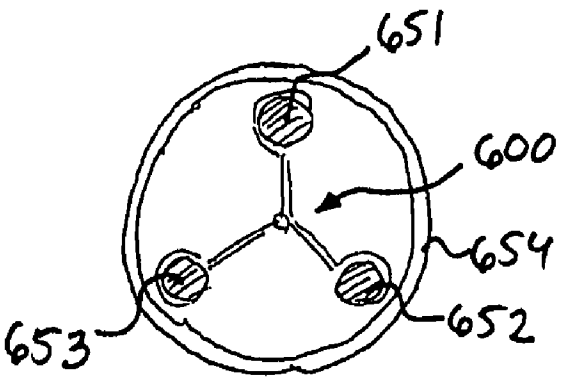
Figure 5A:
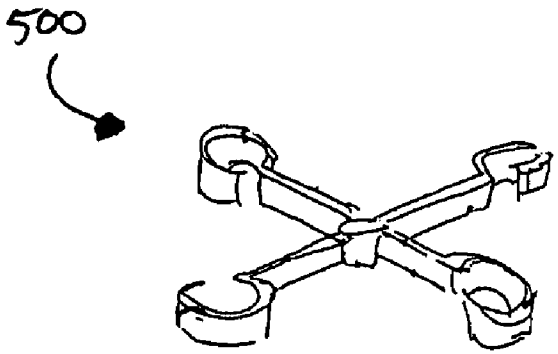
FIGS. 5A and 5B are views of a spacer for use with four support bars according to one embodiment of the invention.
Figure 5B:
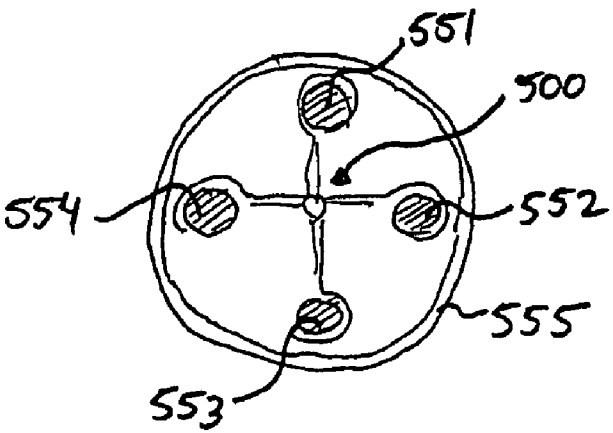

FIGS. 5A and 5B are views of a spacer for use with four support bars according to one embodiment of the invention. FIGS. 6A and 6B are views of a spacer for use with three support bars according to an alternative embodiment of the invention. Additionally, it is within the scope of this invention to utilize any number of support bars in a similar fashion as discussed with reference to FIGS. 5A through 6B.

FIGS. 5A and 5B illustrate a spacer 500 to be used with four support bars 551-554. The spacer 500 may be configured to position four support bars 551-554 such that each support bar is located substantially adjacent to the inner surface of the support pole 555 and such that the four support bars are substantially equally spaced, at approximately 90-degree intervals, about the inner circumference of the support pole.

FIGS. 6A and 6B illustrate a spacer 600 to be used with three support bars 651-653. The spacer 600 may be configured to position three clips 601-603 such that each support bar is located substantially adjacent to the inner surface of the support pole 654 and such that the three support bars are substantially equally spaced, at approximately 120-degree intervals, about eh inner circumference of the support pole.

While FIGS. 5A and 6A illustrate configurations of arm members and clips designed to position the support bars within the support pole, it should be obvious to one of ordinary skill in the art that alternative configurations of arm members and clips may be designed without deviating from the scope and spirit of the present invention. For example, alternative embodiment may include clips connected circular arm members forming a circular pattern.

Figure 7A:
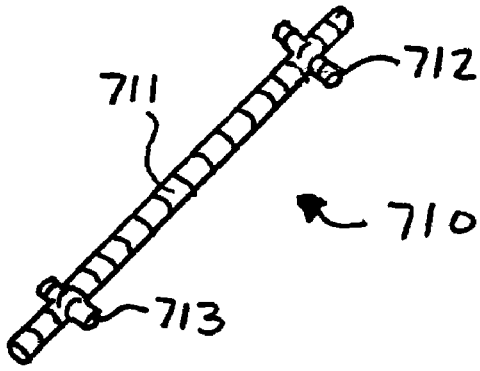
FIGS. 7A and 7B are views of an integrally fabricated support bar and spacers according to one embodiment of the invention.
Figure 7B:
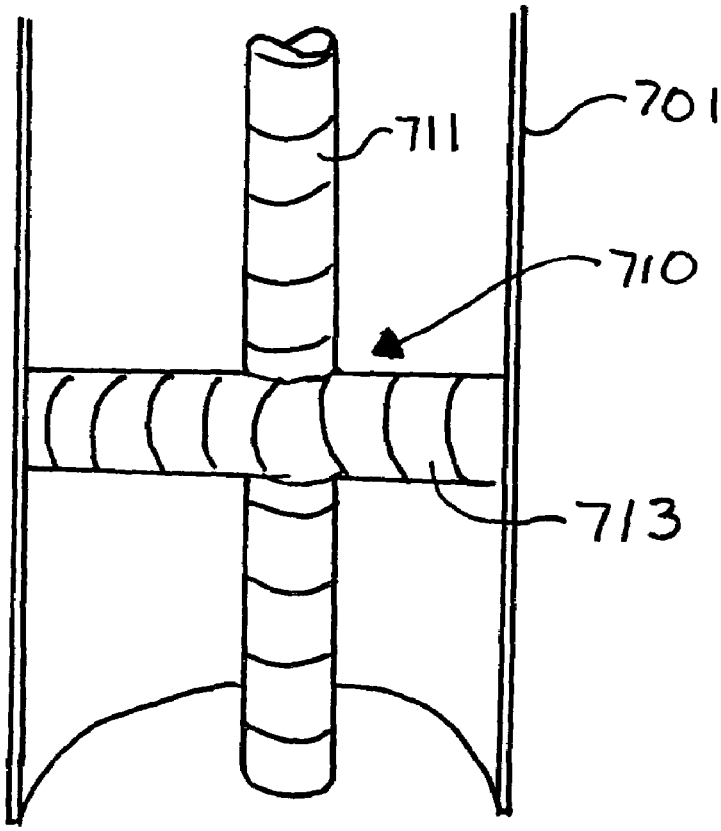

As shown in FIGS. 7A and 7B, it is also contemplated that the spacers may be integrally fabricated with the support bar from similar or even different materials such that a consumer, upon choosing to include the support bar in the installation, need not bother with separate clips. The support bar 710 includes the main support bar 711 along with attached spacers 712 and 713. The spacers 712 and 713 may be welded to the main support bar 711 or the entire support bar 710 may be fabricated from a single element, such as being forged or machined as a single piece of metal. In the embodiment shown in FIGS. 7A and 7B, the support bar 710 simplifies the assembly of the support pole by dispensing with the separate spacers which may be lost or misplaced during assembly of a sports apparatus. It is also contemplated that multiple support bar configurations, as shown in FIGS. 5A through 6B, may also be fabricated as a single reinforcement device.

In addition to using the support structure of the present invention for supporting a basketball goal, it is envisioned that the present invention can be utilized as a support structure for other types of support poles. This may include support poles for volleyball nets, soccer goals, flagpoles or the like. Thus, the use of the invention in a basketball support pole is not to be construed as limiting the scope of the present invention.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. A method for reinforcing a hollow basketball goal support pole forming a cavity, the basketball goal support pole having a first portion and a second portion, the method comprising the steps of:

attaching at least one spacer to at least one reinforcing bar, the at least one reinforcing bar including a first end and a second end and a first portion and a second portion;

inserting the at least one reinforcing bar and the at least one spacer into the cavity in the first portion of the basketball goal support pole, the at least one spacer being configured to maintain the at least one reinforcing bar in a predetermined position within the first portion of the basketball goal support pole;

maintaining the at least one reinforcing bar in the predetermined position while filling at least a portion of the cavity of the basketball goal support pole with a fill material such that the at least one reinforcing bar is substantially encased in the fill material; and placing the basketball goal support pole such that the first portion of the at least one reinforcing bar, including the first end is positioned below a basketball playing surface and the second portion of the reinforcing bar, including the second end, is positioned above the basketball playing surface;

wherein:

the at least one reinforcing bar is positioned within the basketball goal support pole such that, upon failure in the first portion of the basketball goal support pole, the at least one reinforcing bar slows the rate of descent of the basketball goal support pole;

the basketball goal support pole includes an inner circumference;

the at least one reinforcing bar includes at least three reinforcing bars;

the predetermined position includes locating the first end and the second end of each of the at least three reinforcing bars substantially adjacent to the inner circumference and locating each of the at least three reinforcing bars at substantially equal intervals around the inner circumference of the basketball goal support pole; and the at least one spacer includes at least three clips for attaching to the at least three support reinforcing bars; and at least one member connecting the at least three clips and configured to locate the at least three clips substantially adjacent to the inner circumference and at substantially equal intervals around the inner circumference of the sports basketball goal support pole.

2. The method according to claim 1, wherein the at least one reinforcing bar includes one reinforcing bar and the predetermined position includes locating the first end and the second end of the one reinforcing bar substantially on the central axis of the basketball goal support pole.

3. The method according to claim 2, wherein the at least one spacer includes:

a clip for attaching to the one reinforcing bar; and at least one member connecting to the clip and configured to locate the clip substantially on the central axis of the basketball goal support pole.

4. The method according to claim 2, wherein the one reinforcing bar and the at least one spacer are fabricated as a single unit.

5. The method according to claim 1, wherein:

the basketball goal support pole includes an inner circumference;

the at least one reinforcing bar includes at least three reinforcing bars; and the predetermined position includes locating the first end and the second end of each of the at least three reinforcing bars substantially adjacent to the inner circumference and locating each of the at least three reinforcing bars at substantially equal intervals around the inner circumference of the basketball goal support pole.

6. The method according to claim 1, wherein the at least one spacer is fabricated as a single molded element.

7. The method according to claim 1, wherein the at least one reinforcing bar is formed of at least one of a metal, composite material, and plastic.

8. The method according to claim 1, wherein the fill material includes at least one of concrete, cement, and asphalt.

9. The method of claim 1, wherein the step of placing the basketball goal support pole includes the step of inserting a portion of the first portion of the basketball goal support pole into a ground sleeve.

* * * * *